US005145169A

United States Patent [19]

Kato

[11] Patent Number: 5,145,169

[45] Date of Patent: Sep. 8, 1992

[54] ROLL FEED DEVICE

[75] Inventor: Heizaburo Kato, Shizuoka, Japan

[73] Assignee: Sankyo Manufacturing Company, Ltd., Tokyo, Japan

[21] Appl. No.: 758,197

[22] Filed: Sep. 12, 1991

Related U.S. Application Data

[63] Continuation of Ser. No. 597,340, Oct. 11, 1990, abandoned.

[30] Foreign Application Priority Data

Oct. 11, 1989 [JP] Japan ..... 1-119076[U]

[51] Int. Cl.[5] ..... B65H 5/06

[52] U.S. Cl. ..... 271/272; 198/788

[56] References Cited

U.S. PATENT DOCUMENTS

| | | | |
|---|---|---|---|
| 1,743,223 | 1/1930 | Löwy | 198/788 |
| 1,868,825 | 7/1932 | Grosjean | 198/788 |
| 1,881,267 | 10/1932 | Drexler | 198/788 |
| 1,889,173 | 11/1932 | Drexler | 198/788 |
| 1,898,551 | 2/1933 | MacCutcheon | 198/788 |
| 2,894,744 | 7/1959 | Schulze | 271/272 |
| 3,258,263 | 6/1966 | Littell | 271/272 |
| 3,788,638 | 1/1974 | Lehmann | 271/272 |
| 4,151,431 | 4/1979 | Johnson . | |
| 4,458,893 | 7/1984 | Ruh . | |

FOREIGN PATENT DOCUMENTS

| | | | |
|---|---|---|---|
| 0230605 | 8/1987 | European Pat. Off. . | |
| 1192584 | 5/1965 | Fed. Rep. of Germany . | |
| 86332 | 5/1986 | Japan | 271/109 |

*Primary Examiner*—Robert P. Olszewski
*Assistant Examiner*—Steven M. Reiss
*Attorney, Agent, or Firm*—Pollock, Vande Sande & Priddy

[57] ABSTRACT

A roll feed device includes a rotatable main roll, and a rotatable sub-roll. The main roll includes an annular stator, and an annular rotor rotatably mounted around the annular stator. The annular stator and the annular rotor cooperate with each other to provide a direct drive motor. The sub-roll includes a rotatable annular roll disposed in opposed relation to the annular rotor of the main roll. A sheet-like material is supplied between the annular rotor and the annular roll to be fed.

4 Claims, 2 Drawing Sheets

ROLL FEED DEVICE

This application is a continuation of Ser. No. 07/597,340 filed on Oct. 11, 1990, now abandoned.

BACKGROUND OF THE INVENTION

This invention relates to a roll feed device in which a sheet-like material is held between and fed by a main roll and a sub-roll.

For example, in a cutting machine for cutting a material into a predetermined length or a pressing machine, used in a factory automation system, a sheet-like metal material is intermittently fed by a roll feed device from a roll of such material, and the sheet-like material thus fed is cut or pressed each time the roll feed device stops feeding the material.

Generally, such a conventional roll feed device includes an electric motor as a drive source, and the rotation of the motor is transmitted to a main roll of the roll feed device via intermediate transmitting elements such as a belt, gears, joints and so on. The roll feed device comprises the main roll and a sub-roll disposed in opposed relation to the main roll, and a gap between the main roll and the sub-roll is adjusted according to the thickness of the sheet-like material to be fed therebetween, and is so determined that the main roll and the sub-roll are slightly pressed against the sheet-like material. With this construction, the main roll is driven for rotation, and the sheet-like material is supplied between the main roll and the sub-roll, so that the sheet-like material is fed by the friction between the main roll and the sheet-like material. At this time, the sub-roll is rotated in response to the movement of the sheet-like material.

In such a conventional roll feed device, however, since the rotation of the motor is transmitted to the main roll via the intermediate transmitting elements such as a belt, gear, joints and so on as described above, rattling, backlashes, vibrations and the like, develop in the intermediate transmitting elements. This has resulted in a problem that the uniformity of the feed speed and the positioning accuracy or precision can not be satisfactory. Another problem is that the device tends to be bulky because of the intermediate transmitting elements.

SUMMARY OF THE INVENTION

It is therefore an object of this invention to provide a roll feed device which is highly precise, and is of a compact construction.

According to the present invention, there is provided a roll feed device for feeding a sheet-like material, comprising:

(a) a mounting frame;

(b) a main roll rotatably mounted on the mounting frame, the main roll comprising an annular stator fixedly mounted on the mounting frame, and an annular rotor rotatably mounted on an outer periphery of the annular stator, the annular stator and the annular rotor cooperating with each other to provide a direct drive motor; and (c) a sub-roll rotatably mounted on the mounting frame, the sub-roll comprising a support shaft fixedly mounted on the mounting frame, and an annular roll rotatably mounted on the support shaft, the annular roll being disposed in opposed relation to the annular rotor in such a manner that axes of rotation of the annular roll and the annular rotor are substantially parallel to each other, the sheet-like material being adapted to be supplied between the annular roll and the annular rotor so as to be fed.

When the main roll constituting the direct drive motor is energized, the annular rotor is rotated by a magnetic attractive force produced between the annular stator and the annular rotor provided therearound. The direct drive motor can be a stepping motor, in which case exciting coils are wound respectively on first teeth formed on the outer periphery of the annular stator, and second teeth are formed on the inner periphery of the anular rotor. The exciting coils are sequentially excited so as to sequentially magnetize the first teeth, so that the second tooth closet to a magnetized one of the first teeth is attracted toward this magnetized first tooth, thereby rotating the annular rotor of the main roll. The sheet-like material is supplied between the rotating annular rotor of the main roll and the annular roll of the sub-roll to be fed.

DESCRIPTION OF THE PREFERRED EMBODIMENT OF THE INVENTION

The invention will now be described with reference to the drawings.

Figure 1:
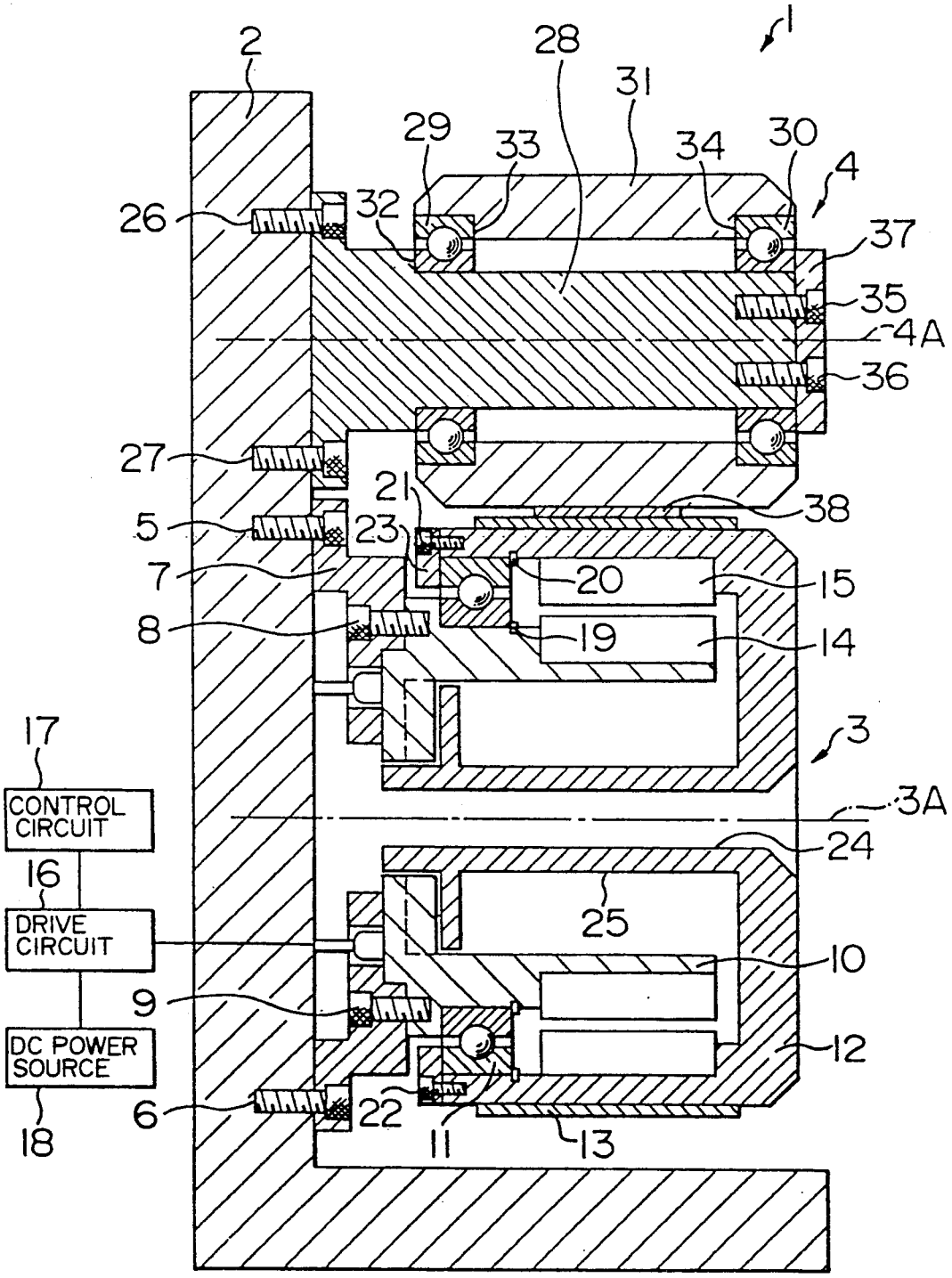
FIG. 1 is a cross-sectional view of a roll feed device according to an embodiment of the present invention.
Figure 2:
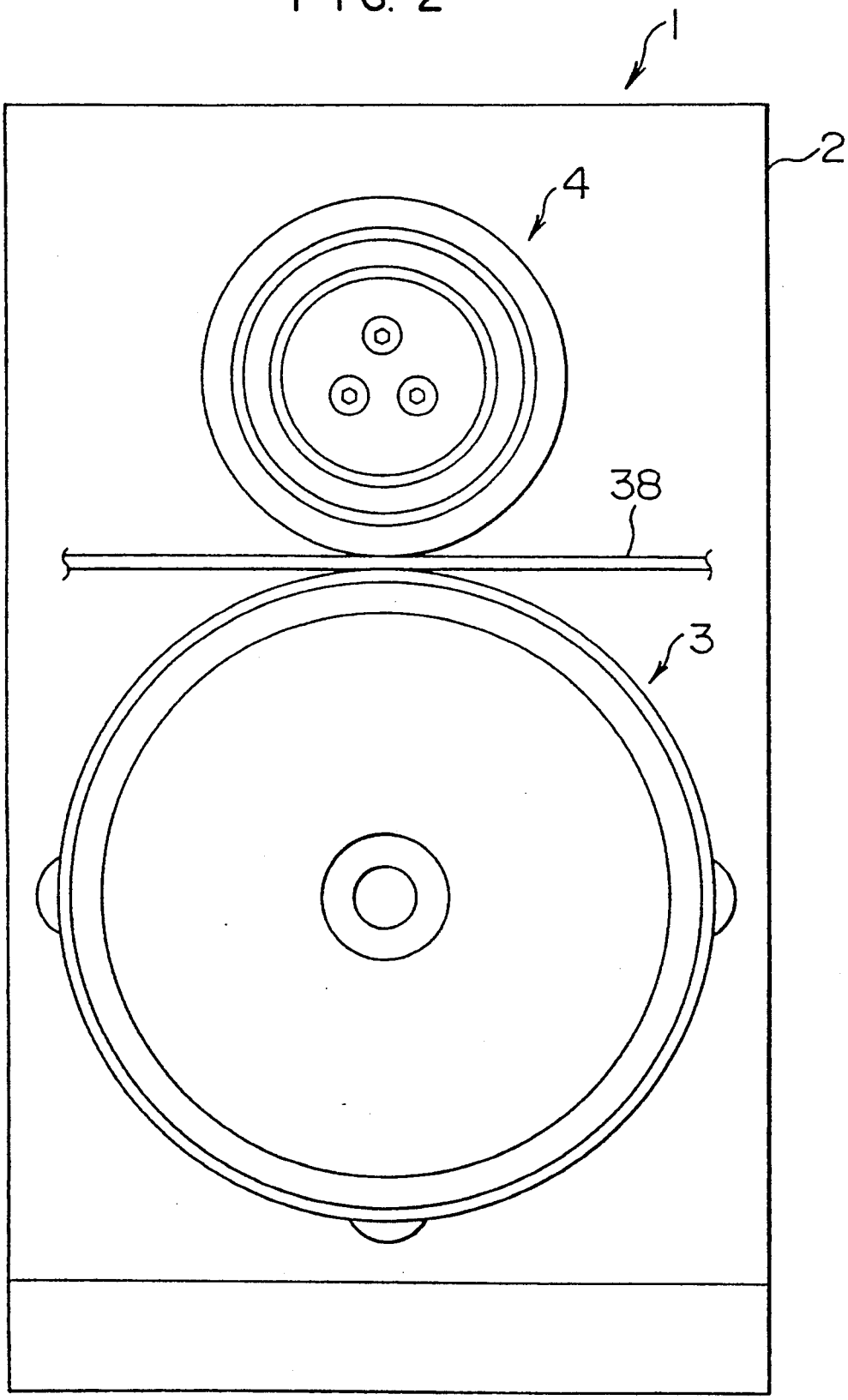
FIG. 2 is a side-elevational view of the roll feed device.

A roll feed device 1 shown in FIGS. 1 and 2 comprises a mounting frame 2 of an L-shaped cross-section, a main roll 3 mounted on the inner surface of the mounting frame 2, and a sub-roll 4 mounted on the inner surface of the mounting frame 2 and disposed in vertically opposed relation to the main roll 3. Axes of rotation 3A and 4A of the main roll 3 and the sub-roll 4 are parallel to each other.

The main roll 3 comprises a base 7 fixedly mounted on the mounting frame 2 by bolts 5 and 6, an annular stator 10 fixedly mounted on the base 7 by bolts 8 and 9, an annular rotor 12 rotatably mounted on the outer periphery of the annular stator 10 through a bearing 11, and an annular cover member 13 fixedly mounted on the outer periphery of the annular rotor 12. The annular stator 10 and the annular rotor 12 cooperate with each other to form a direct drive motor, as will be more fully described later. The base 7 may be formed integrally with the anular stator 10. The annular cover member 13 may be omitted, depending on the nature or properties of a sheet-like material 38 to be fed.

A plurality of teeth 14 are formed on the outer peripheral surface of the annular stator 10 at equal intervals, and an exciting coil (not shwon) is wound on each of the teeth 14. Teeth 15 are formed at equal intervals on the inner peripheral surface of the annular rotor 12 disposed in opposed relation to the teeth 14. The number of the teeth 15 is smaller than the number of the teeth 14. A drive circuit 16 is connected to the exciting coils of the stator 10 so as to sequentially excite these coils in a predetermined order. The drive circuit 16 is connected to a control circuit 17 for controlling the rotational speed, direction and angle of the motor, and also is connected to a DC power source 18. The bearing 11 serves to cause the rotor 12 to smoothly rotate relative to the stator 10, and also serves to accurately keep the gap between the teeth 15 of the rotor 12 and the teeth 14 of the stator 10 as small as possible. One side of the bearing 11 is supported by stop rings 19 and 20 mounted respectively on the outer periphery of the stator 10 and the inner periphery of the rotor 12, and the other side of the bearing 11 is supported by a stop plate 23 fixedly secured to the inner end of the rotor 12 by bolts 21 and 22. The rotor 12 is in the form of a cylinder having a closed bottom and a central shaft portion 25 extending axially of the cylinder, and a bore 24 extends axially through the shaft portion 25. The annular cover member 13 is made of a suitable material so as to provide a suitable frictional force relative to the sheet-like material 38 to be fed.

The sub-roll 4 comprises a support shaft 28 fixedly mounted on the mounting frame 2 by bolts 26 and 27, and an annular roll 31 rotatably mounted on the outer periphery of the support shaft 28 via two bearings 29 and 30. The bearing 29 is supported by a step portion 32 of the support shaft 28 and a step portion 33 of the annular roll 31, and the other bearing 30 is supported by a step portion 34 of the annular roll 31 and a stop plate 37 fixedly secured to the outer end of the support shaft 28 by bolts 35 and 36.

The operation of the roll feed device will now be described. Electric current is supplied to the annular stator 10 of the main roll 3 through the exciting coils (not shown) provided on the stator 10. The electric current is switched from one exciting coil to another in the order determined by the drive circuit 16, so that the exciting coils are sequentially excited in the order of arrangement of these coils. Therefore, the teeth 14 on which the exciting coils are wound, respectively, are sequentially magnetized. The tooth 15 of the rotor 12 closest to the magnetized tooth 14 is attracted toward this magnetized tooth 14, so that the rotor 12 is rotated. Therefore, when the sheet-like material 38 is supplied between the rotating main roll 3 and the sub-roll 4, the sheet-like material 38 is fed by the friction between the sheet-like material 38 and the annular cover member 13 around the main roll 3, and at this time the sub-roll 4 is also rotated in response to the movement of the sheet-like material 38.

In the above embodiment, although the stepping motor of the variable reluctance-type is used as the direct drive motor, there may be used any other suitable motor, such as a stepping motor of the hybrid-type including a rotor made of a permanent magnet and having teeth, and a brushless DC motor. Among such direct drive motors, those having an outer rotor made of a permanent magnet are not suitable for the feeding of a sheet-like material having magnetic properties. Even in this case, however, the feeding of such a sheet-like material can be performed by covering the outer periphery of the rotor with an annular cover member of a non-magnetic material to provide a magnetic shield.

Although the present invention has been specifically described with reference to the illustrated embodiment, various techniques used in the conventional roll feed devices can be employed. For example, the sub-roll may be movable toward and away from the main roll, in which case the sub-roll is spring-biased into contact with the main roll.

As described above, in the roll feed device of the present invention, the main roll is in the form of the direct drive motor of the outer rotor-type. Therefore, the roll feed device of the present invention is free from the rattling and backlashes inherent to the conventional device, and is highly precise, and can be of a compact construction.

What is claimed is:

1. A roll feed device for feeding a sheet-like material, comprising:

(a) a mounting frame;

(b) a main roll rotatably mounted on said mounting frame, said main roll comprising an annular stator fixedly mounted on said mounting frame, and an annular rotor rotatably mounted on an outer periphery of said annular stator, said annular stator and said annular rotor of said main roll cooperating with each other to provide a direct drive motor; and (c) a sub-roll rotatably mounted on said mounting frame, said sub-roll comprising a support shaft fixedly mounted on said mounting frame, and an annular roll rotatably mounted on said support shaft, said annular roll being disposed in opposed relation to said annular rotor in such a manner that axes of rotation of said annular roll and said annular rotor are substantially parallel to each other;

wherein the sheet-like material is supplied and feed between said annular roll of said sub-roll and said annular rotor of said main roll.

2. A roll feed device according to claim 1, in which said direct drive motor is a stepping motor.

3. A roll feed device according to claim 1, in which an annular cover member is mounted on the outer periphery of said annular rotor for frictional contact with the sheet-like material.

4. A roll feed device for feeding a sheet-like material comprising:

(a) a supporting frame;

(b) a first feeding roll composed of an annular stator fixedly mounted on said supporting frame and an annular rotor rotatably mounted on an outer periphery of said annular stator, said annular stator and rotor forming a drive motor, said annular rotor also defining an outer surface of said first feeding roll; and (c) a second feeding roll composed of a support shaft fixedly mounted on said supporting frame and an annular roll rotatably mounted on said support shaft and having an outer surface, said annular roll being disposed opposite to said annular rotor with the axes of rotation of said annular roll and said annular rotor being substantially parallel to each other; and wherein the sheet-like material is supplied and fed between said outer surface of said first feeding roll and said outer surface of said annular roll of said second feeding roll.

* * * * *